United States Patent [19]

Pawlowski

[11] 4,229,629

[45] Oct. 21, 1980

[54] MINIATURE PNEUMATIC SWITCH ACTUATOR

[76] Inventor: Eugene J. Pawlowski, 10621 Bloomfield Ave., Unit 32, Los Alamitos, Calif. 90720

[21] Appl. No.: 17,065

[22] Filed: Mar. 1, 1979

[51] Int. Cl.[3] ..... H01H 35/38

[52] U.S. Cl. ..... 200/82 R; 200/82 C; 200/303

[58] Field of Search ..... 200/82 R, 82 C, 302, 200/303, 81 R

[56] References Cited

U.S. PATENT DOCUMENTS

| | | | |
|---|---|---|---|
| 2,764,645 | 9/1956 | Smith | 200/82 R |
| 3,039,833 | 6/1962 | Farkas | 200/82 C |
| 3,077,524 | 2/1963 | Blackburn | 200/82 R |
| 3,379,841 | 4/1968 | Lombard | 200/82 R |
| 3,444,341 | 5/1969 | Mighton | 200/82 C |
| 3,619,526 | 11/1971 | Riley | 200/82 C |
| 4,158,120 | 6/1979 | Pawlowski | 200/82 C |

*Primary Examiner*—Gerald P. Tolin

[57] ABSTRACT

The present invention is a miniature electric switch actuator comprised of a two-piece threaded housing, one section having a cylindrical cavity containing a miniature switch with wires attached and the adjoining section has an inlet port and a bore with a spring biased piston. The piston is retained in the bore by a snap ring which limits the progression of the piston. In response to pressure, the piston depresses the switch push button to a controlled depth.

1 Claim, 4 Drawing Figures

FIG. 1
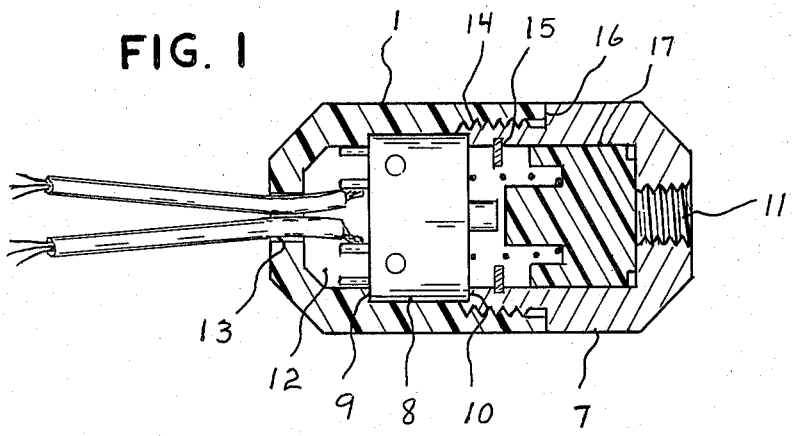
FIG. 2
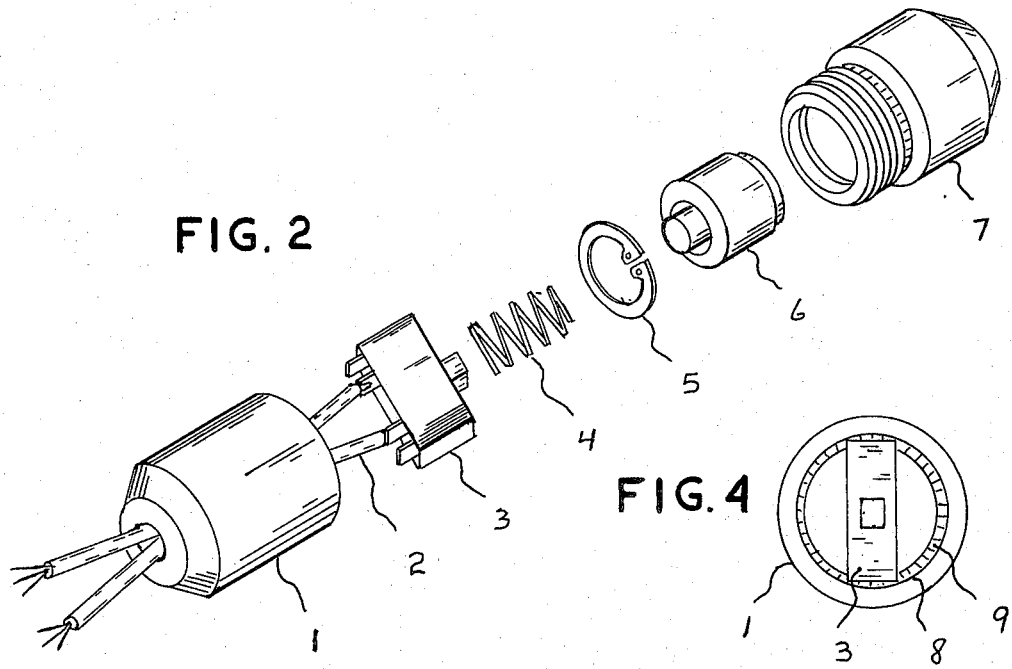
FIG. 4
FIG. 3
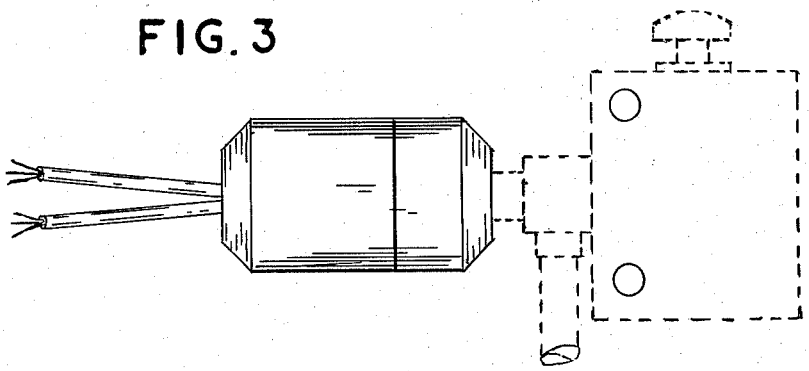

MINIATURE PNEUMATIC SWITCH ACTUATOR

BACKGROUND OF THE INVENTION

1. Field of the Invention

The present invention pertains to a miniature electric switch actuator that is flow responsive, in which fluid acts on a piston which moves in a cylinder to provide a switch means.

2. Description of the Prior Art

It is known existing switch actuators are large and built for exterior use while favoring an adjusting device which is not always essential. It is the principal object of the present invention to provide a lightweight switch actuator with capsule-like features readily installed either with a miniature adaptor or be suspended by the pressure supply tube, and is for use in an air and electric logic system of limited space within a protective enclosure. Another prominent feature of this invention is to provide a switch actuator of only four working parts retained in a 2-piece housing while being responsive to pressure in the range of ½ to 100 PSI and without requiring any adjusting means. Another advantage is the close fit free-floating piston with no seal, rather than a diaphram, to provide a compact switching means.

SUMMARY OF THE INVENTION

The present invention is a switching means in miniature form to provide an air and electric interlock with no adjustment required while effectively operating in a range of ½ to 100 PSI. A particular feature is the configuration of a spring biased piston and the use of an internal snap ring to prevent overtravel of the piston while actuating the electric switch.

BRIEF DESCRIPTION OF THE DRAWING

FIG. 1 is a longitudinal sectional view of the assembled housing of the pneumatic switch actuator of the present invention, shown unpressurized.

FIG. 2 is an exploded view showing the switch housing, an electric switch with wires attached, a biasing spring, snap ring, piston, and piston housing relating to centerline of the pneumatic switch actuator of the present invention.

FIG. 3 is a front elevation view of the pneumatic switch actuator of the present invention with a valve attached.

FIG. 4 is a cross section view of the pneumatic switch actuator of the present invention showing the switch housing bore with an electric switch in position.

DESCRIPTION OF THE PREFERRED EMBODIMENT

As shown in FIG. 1 according to the present invention a cylindrical switch housing 1 is composed of insulation material having a bore 8 suitable to contain an electric switch 3 with the actuation centerline on the same axis as the switch bore 8 and held to a depth determined by a step 9 in the switch bore 8 while allowing the switch terminals with wires 2 attached to extend into an adjacent lesser bore 12, having an outlet 13 of sufficient size to allow the wires 2 to protrude. The switch housing 1 has an internal thread 14 adjacent to the switch bore 8 to attach the piston housing 7 by a mating thread and retain the switch 3 in position, while providing alignment of the piston 6 and the switch 3 on centerline. A snap ring groove 15 is provided near the outer end of the piston bore 17 to contain a snap ring 5 which limits the progression of the spring biased piston 6 to a controlled depth while actuating the switch 3 when pressure is applied to the inlet port 11 of the present invention. A biasing spring 4 which is reduced in size on one end to create a gripping means for the purpose of retaining the biasing spring 4 in the recessed end of the piston 6 to prevent losing the biasing spring 4 when the housings 1 and 7 are disassembled.

As shown in FIG. 1 and FIG. 4 according to the present invention the switch housing bore 8 retains the switch in position on centerline while being locked against a shoulder 9 by the threaded end 10 of the piston housing 7 which also has a shoulder 16 to control the depth to which the piston housing 7 may enter the threaded bore 14 of the switch housing 1. As shown in FIG. 1 the shoulders 9, 10, and 16 provide a predetermined location of the switch for the purpose of a controlled switch actuation when the 2-piece housing containing the switch, spring biased piston, and snap ring are assembled. As shown in FIG. 2 the spring biased piston 6 is made of a bearing type of plastic to provide a free-floating movement in the piston bore 17 when this invention is used in the low pressure range. Only pure non-lubricated air must be used with this invention.

I claim:

1. A miniature pneumatic switch device having a two-piece capsule-shaped housing connected by a thread means, a first half of said housing having an internal thread and a bore with a shoulder of predetermined depth in which a switch with wires attached is retained on centerline, said wires protruding beyond said shoulder through an aperture at the end of said housing, the other half of said housing having an external thread of predetermined length extending from a shoulder to provide an assembly means of said two-piece housing and a means of retaining said switch in position, said other half of housing having a smaller bore with a flat bottom of predetermined depth, said bottom having a threaded inlet port to allow pressure to enter therein, said smaller bore having a spring-biased free-floating piston limited in axial movement toward said switch by a retaining ring, whereby said piston causes actuation of said switch when pressure is applied to said inlet port.

* * * * *